US011167879B2

(12) United States Patent
Hisamitsu

(10) Patent No.: US 11,167,879 B2
(45) Date of Patent: Nov. 9, 2021

(54) PACKAGING BOX SHEET

(71) Applicant: Noriyuki Hisamitsu, Tokyo (JP)

(72) Inventor: Noriyuki Hisamitsu, Tokyo (JP)

( * ) Notice: Subject to any disclaimer, the term of this patent is extended or adjusted under 35 U.S.C. 154(b) by 0 days.

(21) Appl. No.: 16/637,738

(22) PCT Filed: Jul. 27, 2018

(86) PCT No.: PCT/JP2018/028303

§ 371 (c)(1),
(2) Date: Feb. 7, 2020

(87) PCT Pub. No.: WO2019/031279

PCT Pub. Date: Feb. 14, 2019

(65) Prior Publication Data

US 2020/0207509 A1 Jul. 2, 2020

(30) Foreign Application Priority Data

Aug. 8, 2017 (JP) ..... JP2017-153279
Aug. 29, 2017 (JP) ..... JP2017-164042

(51) Int. Cl.
*B65D 5/62* (2006.01)
*B65D 5/28* (2006.01)

(52) U.S. Cl.
CPC ..... *B65D 5/62* (2013.01); *B65D 5/28* (2013.01)

(58) Field of Classification Search
CPC ... B65D 5/62; B65D 5/28; B65D 5/82; B65D 5/32

(Continued)

(56) References Cited

U.S. PATENT DOCUMENTS 1,364,896 A 1/1921 Smith
4,463,893 A * 8/1984 Brunone ..... B65D 5/32 206/468

(Continued)

FOREIGN PATENT DOCUMENTS

CN 106379603 A 2/2003
CN 201472751 U 5/2010

(Continued)

OTHER PUBLICATIONS

International Search Report and Written Opinion for PCT/JP2018/028303 dated Sep. 11, 2018.

(Continued)

*Primary Examiner* — Christopher R Demeree
(74) *Attorney, Agent, or Firm* — Kenealy Vaidya LLP

(57) ABSTRACT

A packaging box sheet capable of transporting without consuming space, assembled to obtain a box. The box sheet includes: a mounting board; and a decorative paper on the mounting board surface; where the mounting board includes: a bottom board; and first and second side boards connected to two sides sharing one apex at the bottom board; where the decorative paper includes: a first paper portion affixed to the bottom board; a second paper portion corresponding to the second side boards, where the second paper portion is connected to the first paper portion, and where the second paper portion is separated from the second side boards; and a third paper portion connected to the first paper portion and where the third paper portion projects from the first side boards toward the second side boards; and wherein the second and the third paper portion have an adhesive layer and a release paper.

11 Claims, 9 Drawing Sheets

(58) Field of Classification Search
USPC ..... 229/116.5, 923, 87.19; 220/359.3; 40/638
See application file for complete search history.

(56) References Cited

U.S. PATENT DOCUMENTS

| | | | | | |
|---|---|---|---|---|---|
| 4,813,548 | A * | 3/1989 | Wyberg | B65D 5/068 | 229/138 |
| 4,869,372 | A * | 9/1989 | Wyberg | B65D 5/068 | 229/249 |
| 4,940,190 | A * | 7/1990 | Groves | A47G 21/001 | 206/559 |
| 4,978,056 | A * | 12/1990 | Ball | B65B 61/02 | 229/123.2 |
| 2010/0009828 | A1* | 1/2010 | Flynn | B65D 5/62 | 493/89 |

FOREIGN PATENT DOCUMENTS

| | | | |
|---|---|---|---|
| CN | 106275687 | A | 1/2017 |
| CN | 106379603 | A | 2/2017 |
| JP | S54-2540 | U1 | 1/1979 |
| JP | H06-44720 | U | 6/1994 |
| JP | 2003-112788 | A | 4/2003 |
| JP | 2003-341253 | A | 12/2003 |
| JP | 2003341253 | A | 12/2003 |
| JP | 2006-131246 | A | 5/2006 |
| JP | 2006131246 | A | 5/2006 |
| JP | 3188708 | U | 1/2014 |
| JP | 3188708 | U | 2/2014 |
| WO | 2019/031279 | A1 | 2/2019 |

OTHER PUBLICATIONS

Chinese Office Action and Search Report for CN 2701-1901412PCT dated Dec. 3, 2020.

* cited by examiner

PACKAGING BOX SHEET

TECHNICAL FIELD

The present invention relates to a packaging box sheet that can be assembled into an affixed box.

BACKGROUND ART

Conventionally, a "Hari-bako" (literally translated into English as an affixed box) is known as a packaging box suitable for storing items such as confectionery, tea, etc. and gift items. In the case of delivering such affixed boxes, since these affixed boxes are delivered to the delivery destination in an assembled state, there is a disadvantage that the delivery cost tends to be expensive because more space is required compared with its weight. Further, for the party receiving these affixed boxes, there is a disadvantage that extensive space is required for storing the affixed boxes.

With respect to the disadvantages stated above, for example, Japanese Unexamined Patent Application Publication No. H07-061441 (Patent Document 1) discloses a technique where an affixed box is flattened by cutting the four corners of the side board portion of the once assembled affixed box to reduce the volume of the affixed box at the time of transportation and storage, and then the four cut corners of the flattened affixed box are bonded with an adhesive to restore the original form at the time of use.

PRIOR ART DOCUMENT

Patent Document

Patent Document 1: Japanese Unexamined Patent Application Publication No. H07-061441

SUMMARY OF THE INVENTION

Problem to be Solved by the Invention

However, for the shop clerks in a store or the like who uses affixed boxes to bond again the once cut affixed boxes with an adhesive during sales operation is a heavy burden. Further, the affixed box formed in this way is likely to result in a deteriorated aesthetic appearance compared to the affixed box which has not been cut, due to protrusion, etc. of the adhesive. Moreover, when food such as confectionery is boxed in the affixed box, there is a possibility that the adhesive is exposed on the inner side of the box and contacts the confectionery, etc. Therefore, from the aforementioned viewpoints, improvement is desired.

In a specific aspect, it is an object of the present invention to provide a packaging box sheet which can be transported and stored without taking up space, and can easily be assembled to obtain an affixed box that is excellent in aesthetic appearance.

Means for Solving the Problem

A packaging box sheet according to one aspect of the present invention is a packaging box sheet assembled to obtaining an affixed box including: (a) a sheet-like mounting board; and (b) a decorative paper disposed on the outer surface of the mounting board; (c) where the mounting board includes: a bottom board whose outer periphery is a polygonal shape when viewed in a plane view; and a plurality of first side boards and a plurality of second side boards respectively connected to two sides sharing one apex at the outer periphery of the bottom board; (d) where the decorative paper includes: a first paper portion affixed to the bottom board and/or the plurality of first side boards in advance; a second paper portion which corresponds to the plurality of second side boards, where the second paper portion is connected to the first paper portion, and where the second paper portion is not affixed to and is separated from the plurality of second side boards; and a third paper portion which is connected to the first paper portion and where the third paper portion projects from one side of the plurality of first side boards toward the plurality of second side boards; (e) where the second paper portion and the third paper portion respectively have an adhesive layer and a release paper covering the adhesive layer.

According to the above configuration, it is possible to provide a packaging box sheet which can be transported and stored without taking up space, and can easily be assembled to obtain an affixed box that is excellent in aesthetic appearance.

MODE FOR CARRYING OUT THE INVENTION

Figure 1:
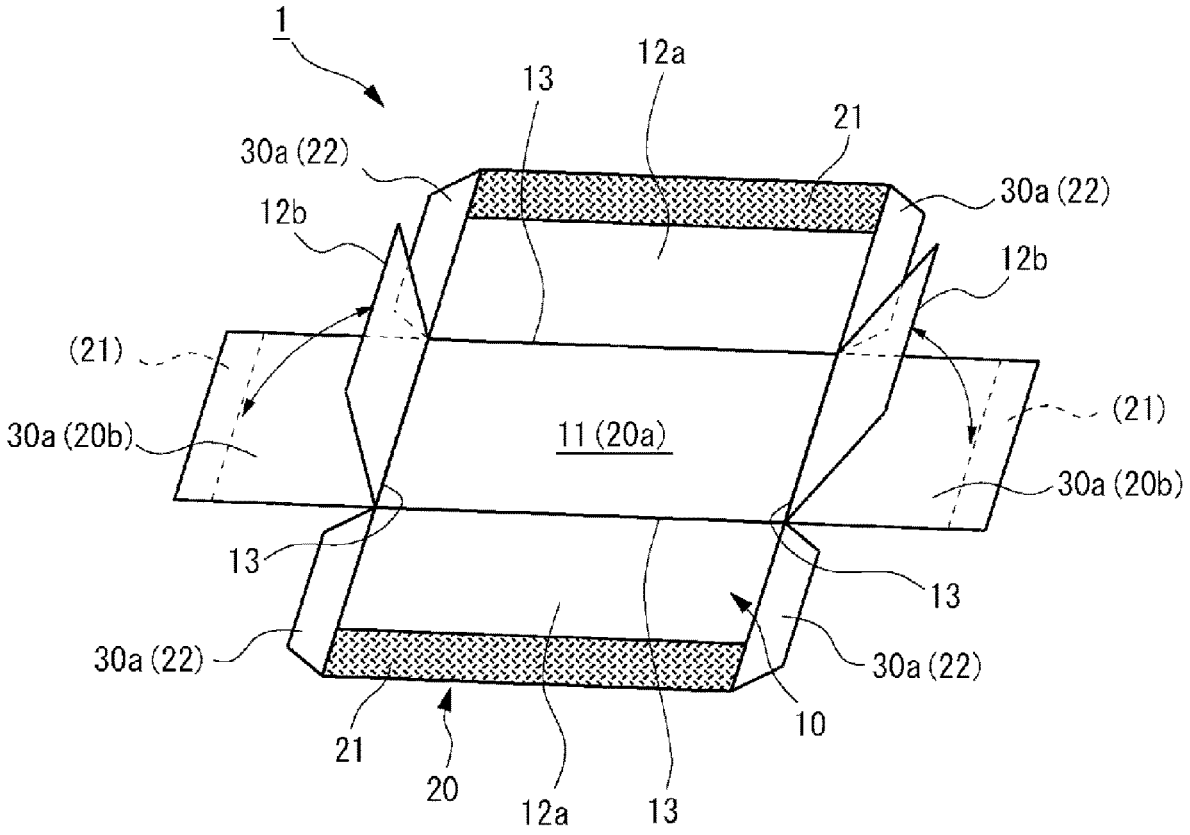
FIG. 1 is a perspective view of a packaging box sheet.
Figure 2:
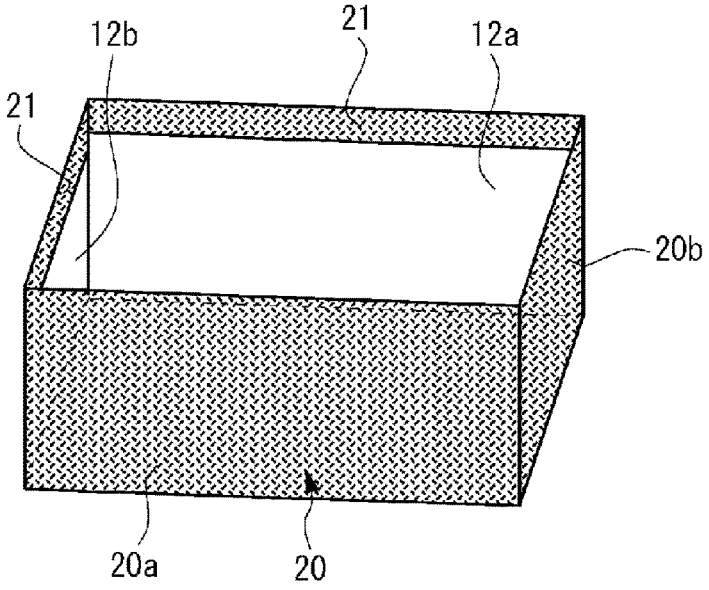
FIG. 2 is a perspective view of a packaging box after a packaging box sheet is being assembled.

FIG. 1 is a perspective view of a packaging box sheet 1 according to one embodiment, and the figure shows the perspective view of a packaging box sheet 1 when viewed from the mounting board 10 side. The illustrated packaging box sheet 1 includes a mounting board 10 which is a core material and a sheet-like decorative paper 20 disposed so as to overlap the entire outer surface of the mounting board 10. As shown in FIG. 2, the packaging box sheet 1 can be assembled into an affixed box having an opening at the top in the figure.

The mounting board 10 is made of a paperboard having a thickness of several mm, for example. The mounting board 10 has a bottom board 11 whose outer periphery is a rectangular shape when viewed in a plane view and four side boards 12*a*, 12*a*, 12*b*, 12*b* connected respectively to the four sides of the outer periphery of the bottom board 11. Notch grooves 13 are respectively provided on the sides to which the side boards 12*a*, etc. and the mounting board 10 are connected. As a result, the side boards 12*a*, etc. are provided so as to be bendable with respect to the bottom board 11.

Among the plurality of side boards 12*a*, for example, in the figure, with regard to the relationship between the side board 12*a* disposed on the upper side of the bottom board 11 and the side board 12*b* arranged on the left side of the bottom board 11, these two side boards are respectively connected to two sides sharing one vertex on the upper left of the outer periphery of the bottom board 11. In other words, these side boards 12*a* and 12*b* are disposed adjacent to each other, with one vertex on the upper left at the outer periphery of the bottom board 11 interposed therebetween in the figure. The relationship between the other side board 12*a* and the side board 12*b* is also the same, and the two side boards are connected to two sides sharing one of the vertexes on the outer periphery of the bottom board 11.

The four side boards 12*a*, 12*a*, 12*b*, 12*b* in the present embodiment are assembled so that the two rectangular side boards 12*a*, 12*a* are arranged to face each other and the two square side boards 12*b*, 12*b* are arranged to face each other (refer to FIG. 2). Further, the surface areas (either the front surface area or the back surface area) of each of the plurality of side boards 12*a* are the same, and are substantially equal to the surface area of the bottom board 11. Further, each of the bottom board 11 and the plurality of side boards 12*a* have surface areas larger than the surface areas (either the front surface area or the back surface area) of each of the plurality of side boards 12*b*. The surface areas (either the front surface area or the back surface area) of each of the plurality of side boards 12*a* are the same.

The notch grooves 13 are provided linearly to the portion where the bottom board 11 and each of the side boards 12*a*, 12*b* are connected and on the inner surface thereof after the packaging box sheet 1 is being assembled. Each notch groove 13 is formed in a V-shaped cross section, for example, and the groove makes it easy to fold each of the side boards 12*a*, 12*b* inward. Note that each notch groove 13 may be provided on the outer surface when assembled.

The decorative paper 20 covers and decorates the whole outer surface of the mounting board 10 and the peripheral edge of the opening of the affixed box after being assembled from the packaging box sheet 1 (refer to FIG. 2). Further, the decorative paper 20 has a portion enabling the adjacent side boards 12*a* and 12*b* to be connected. This decorative paper 20 has arbitrary designs and patterns on the outer surface when the affixed box is assembled from the packaging box sheet 1.

In the present embodiment, first paper portion 20*a* of the decorative paper 20 which opposes the outer surfaces of the bottom board 11 and the plurality of side boards 12*a* is aligned and affixed thereto in advance. In detail, among the decorative paper 20, the first paper portion 20*a* which covers the respective outer surfaces of the bottom board 11 and the two side boards 12*a* is aligned and affixed thereto in advance.

On the other hand, second paper portion 20*b* of the decorative paper 20 which corresponds to the two side boards 12*b* is not affixed thereto in advance, but is separated from the plurality of side boards 12*b*. Therefore, in a state prior to assembling, each side board 12*b* is in a state where it is separated and independent from the decorative paper 20 and can be bent freely along the notch groove 13 (refer to FIG. 1).

Figure 3:
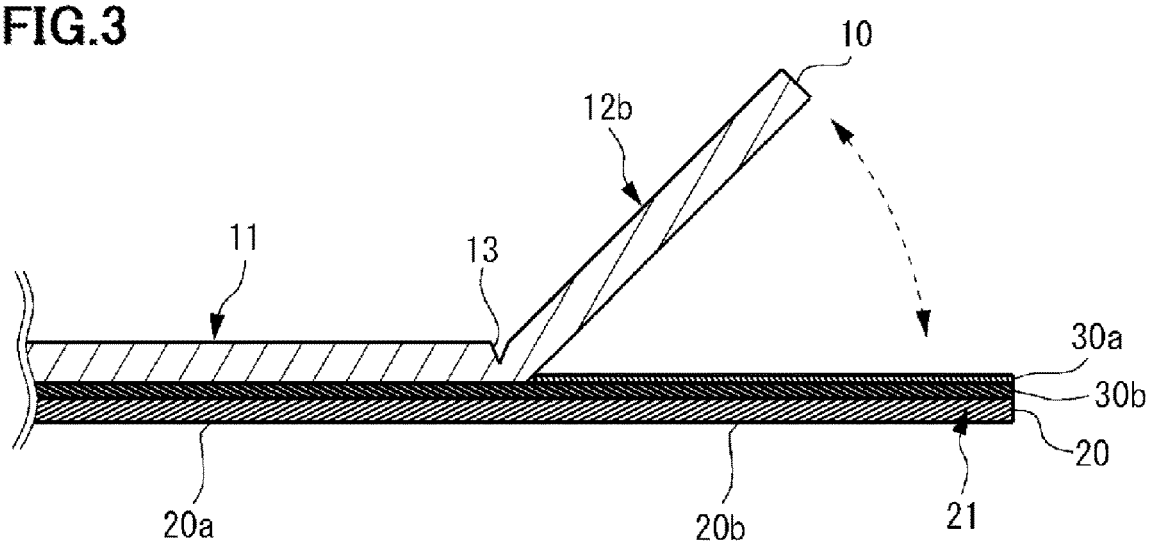
FIG. 3 is a cross-sectional view of the side board portion of the packaging box sheet.

Further, as shown in the partial cross-sectional view in FIG. 3, on each second paper portion 20*b* of the decorative paper 20 which correspond to each side board 12*b*, a pressure sensitive adhesive layer (adhesive layer) 30*b* and a release paper 30*a* covering the pressure sensitive adhesive layer 30*b* are provided. When assembling the affixed box, each release paper 30*a* provided at each second paper portion 20*b* corresponding to each side board 12*b* is peeled off, and each pressure sensitive adhesive layer 30*b* at the second paper portion 20*b* is brought into contact with the outer surface of each side board 12*b*, thereby enabling each second paper portion 20*b* of the decorative paper 20 to be easily affixed to each side board 12*b*. At this time, since each second paper portion 20*b* of the decorative paper 20 corresponding to each side board 12*b* is connected in advance to the first paper portion 20*a* of the decorative paper 20 near the side where the notch groove 13 is provided and is in a state where its position in relation to the bottom board 11 is aligned, misalignment is unlikely to occur when affixing each second paper portion 20*b* to each side board 12*b*.

Among the portions corresponding to the side boards 12*a*, 12*b* of the decorative paper 20, at the edge portion on the side opposing the bottom board 11 (that is, the peripheral edge of the opening when assembled), a plurality of folding-in strips 21 which is folded inward to cover the inner side of side boards 12*a*, 12*b* is provided. These folding-in strips 21 have substantially the same length as that of the edge portion of the side boards 12*a*, 12*b* and have a predetermined width (for example, about 1 cm) sufficient enough to fold inward.

Among the surfaces of the folding-in strips 21 corresponding to the side boards 12*b*, on the same surface as the surface of the decorative paper 20 on which the pressure-sensitive adhesive layer 30*b* is provided, the pressure-sensitive adhesive layer 30*b* and the release paper 30*a* covering the pressure-sensitive adhesive layer 30*b* are provided. In the present embodiment, the release paper 30*a* provided on the folding-in strip 21 of the decorative paper 20 and the release paper 30*a* provided on the second paper portion 20*b* are integrated. When assembling the affixed box, each release paper 30*a* provided across the folding-in strip 21 and the second paper portion 20*b* is peeled off, then the second paper portion 20*b* is affixed to the side board 12*b* and the folding-in strip 21 is folded inside the side board 12*b* thereby enabling each folding-in strip 21 to be affixed to the inside of each side board 12*b*. On the other hand, each folding-in strip 21 corresponding to each side board 12*a* is folded inward and affixed to the inside of each side board 12*a* in advance. Due to these folding-in strips 21, since it is possible to decorate from the edge portion of each of the side boards 12*a*, 12*b* of the mounting board 10 to the part of the inner surface with the decorative paper 20, the aesthetic appearance of the edge portions of the side boards 12*a*, 12*b* can be improved.

Among the first paper portions 20*a* of the decorative paper 20 corresponding to each side board 12*a*, at the edge portions (the side edge portions) extending from the bottom board 11, there is provided a plurality of flap parts 22 which is a third paper portion whose purpose is to connect the adjacent side board 12*a* and the side board 12*b* when assembling the affixed box. As shown in FIG. 1, when viewed in a plane view, each flap part 22 is connected to the first paper portion 20*a* of the decorative paper 20 corresponding to the side board 12*a*, and is provided so as to project from one side of the side board 12*a* toward the side board 12*b* side, and is arranged in a region interposed by a pair of adjacent side boards 12*a* and 12*b*.

Each flap part 22, for example, as shown in the figure, has a trapezoid-shaped outer periphery whose base is formed to have substantially the same length as that of the side edge portion of each side board 12*a*, and is arranged so as to correspond to the side edge portion. Among the surfaces of the flap parts 22, on the same surface as the surface of the decorative paper 20 on which the pressure-sensitive adhesive layer 30*b* is provided, similar to the second paper portion 20*b*, the pressure-sensitive adhesive layer 30*b* and the release paper 30*a* covering the adhesive layer 30*b* are provided (refer to FIG. 3). When assembling the affixed box, the release paper 30*a* of the flap part 22 is peeled off, then the flap part 22 is affixed to the outer surface of the adjacent side board 12*b*, thereby enabling a pair of the adjacent side board 12*a* and side board 12*b* to be connected, resulting in easy assembly of the packaging box sheet 1. Thus, each flap part 22 has a flap width (for example, about 1 cm) sufficient enough to connect the side boards.

The packaging box sheet 1 of the present embodiment has the configuration as described above and nextly, its assembly procedure will be described with reference to FIG. 4. Note that the following procedure is merely an example and procedures may be swapped as long as there is no inconsistency in the assembly.

Figure 4A:
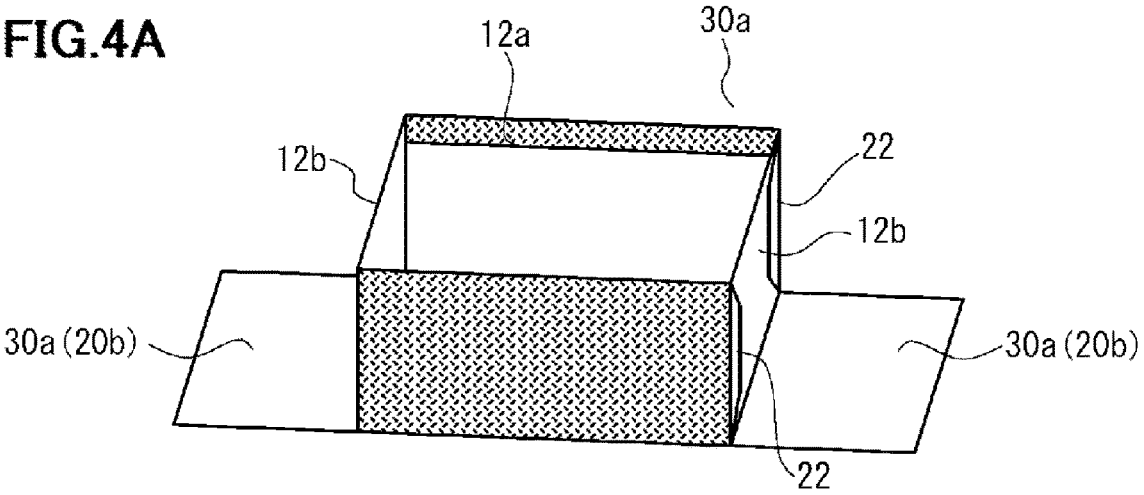
FIGS. 4A and B are perspective views for explaining the method of assembling a packaging box sheet.

First, from the flat state as shown in FIG. 1, as shown in FIG. 4(A), the side boards 12*a* and 12*b* are bent by substantially 90 degrees along the notch groove 13 so as to stand upright against the bottom board 11. Next, the release paper 30*a* of each flap part 22 is peeled off, and while one side of the adjacent side boards 12*a* and 12*b* are brought into contact with each other, the flap parts 22 are affixed respectively to the outer surface of each side board 12*b*. Thus, the adjacent side boards 12*a* and 12*b* are connected to each other.

Figure 4B:
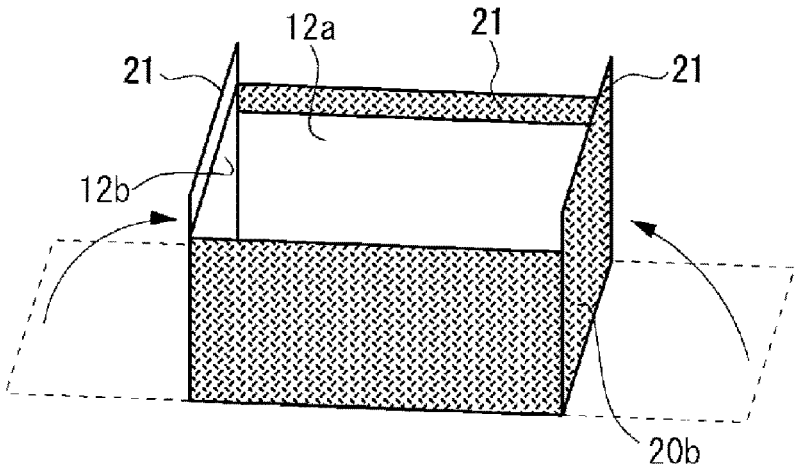

Next, as shown in FIG. 4(B), each release paper 30*a* which corresponds to the second paper portion 20*b* of the decorative paper 20 corresponding to the side board 12*b* and the folding-in strip 21 is peeled off, then the decorative paper 20 is affixed to the outer surface of the side boards 12*b* and each folding-in strip 21 is folded inward toward the side boards 12*b* to be affixed to the inner surface of the side boards 12*b*. According to the above, the affixed box is completed (refer to FIG. 2).

According to the packaging box sheet 1 of the embodiment as described above, since the packaging box sheet 1 is in the form of a sheet prior to being assembled, it can be transported to the delivery destination in a space-saving manner at a low cost. Further, at the delivery site, only a small storage space is required, and when an affixed box is in need, the affixed box can be easily assembled with excellent aesthetic appearance even when the box assembler does not have special skills or manual dexterity. Specifically, since the bottom board 11 and each side board 12*a* are affixed to the decorative paper 20 in advance, during the assembly at a site such as a confectionery shop, misalignment of the decorative paper 20 is unlikely to occur. Further, since each side board 12*b* and the decorative paper 20 are not affixed in advance, after the pair of side board 12*a* and side board 12*b* adjacent to each other are connected by the flap part 22, the portion of the decorative paper 20 can be affixed to the side board 12*b* so as to cover the flap part 22, thereby the flap part 22 can be brought into a state where it cannot be seen from the outside. Thus, the aesthetic appearance of the packaging box is improved. Here, even when the flap part 22 is intentionally assembled to appear outside, since this achieves an extraordinary appearance, such an assembly method is not excluded.

Next, an example of the manufacturing method of the packaging box sheet 1 of the above embodiment will be described.

Figure 5:
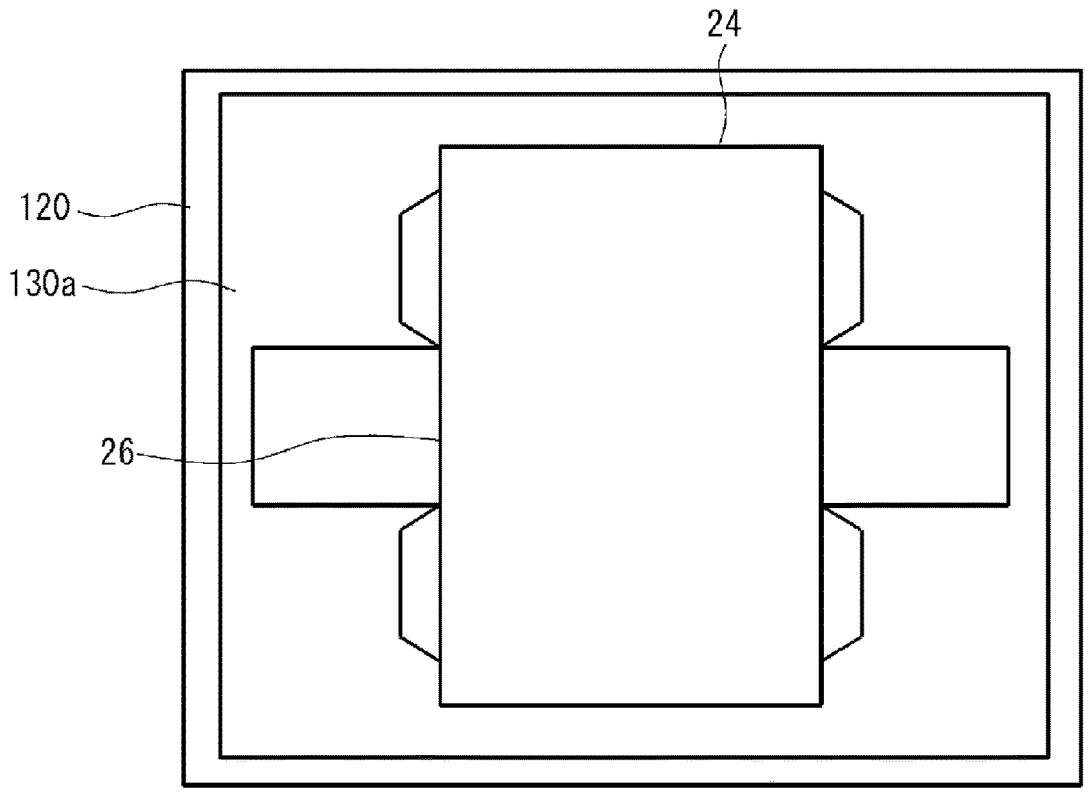
FIG. 5 is a figure for explaining the manufacturing process of a packaging box sheet.

First, a pressure-sensitive adhesive layer 30*b* is formed by applying an adhesive on the upper surface of a decorative paper sheet 120 which becomes a base material of the decorative paper 20, and over this surface, a release paper sheet 130*a* which becomes a base material of the release paper 30*a* is affixed (refer FIG. 5). As a result, the decorative paper sheet 120, the pressure-sensitive adhesive layer 30*b*, and the release paper sheet 130*a* are laminated in this order.

Next, the laminated member including the decorative paper sheet 120, etc. is punched out. Here, cutter blades with two different cutting depth are prepared for punching, one cutter blade having a depth which reaches the back face of the laminated member, and the other cutter blade having a depth which does not reach the back face of the laminated member and reaches only the release paper sheet 130*a* when pressed in from the sheet 130*a* side. Or the other cutter blade may have a depth which reaches the release paper sheet 130*a* and the pressure-sensitive adhesive layer 30*b* but not the decorative paper sheet 120.

Then, by pressing in the cutter blade having a relatively deep depth into the laminated member from the release paper sheet 130*a* side, as shown in FIG. 5, along the outer contour line of the packaging box sheet 1, that is, along the outer contour line 24 of the outer shape obtained by appending the outer periphery of the folding-in strips 21 and the flap parts 22 to the outer periphery of the mounting board 10 when viewed in the plane view, the release paper sheet 130*a*, the pressure-sensitive adhesive layer 30*b*, and the decorative paper sheet 120 are cut.

Next, by pressing the cutter blade having a relatively shallow depth into the laminated member from the release paper 30*a* side, along the contour line 26 of the rectangular area which corresponds to the bottom board 11 of the mounting board 10, the side boards 12*a* and the folding-in strips 21 of the side boards 12*a*, the release paper sheet 130*a* is cut.

Here, the two cutter blades having different depth may be pressed in simultaneously to cut the laminated member.

Figure 6:
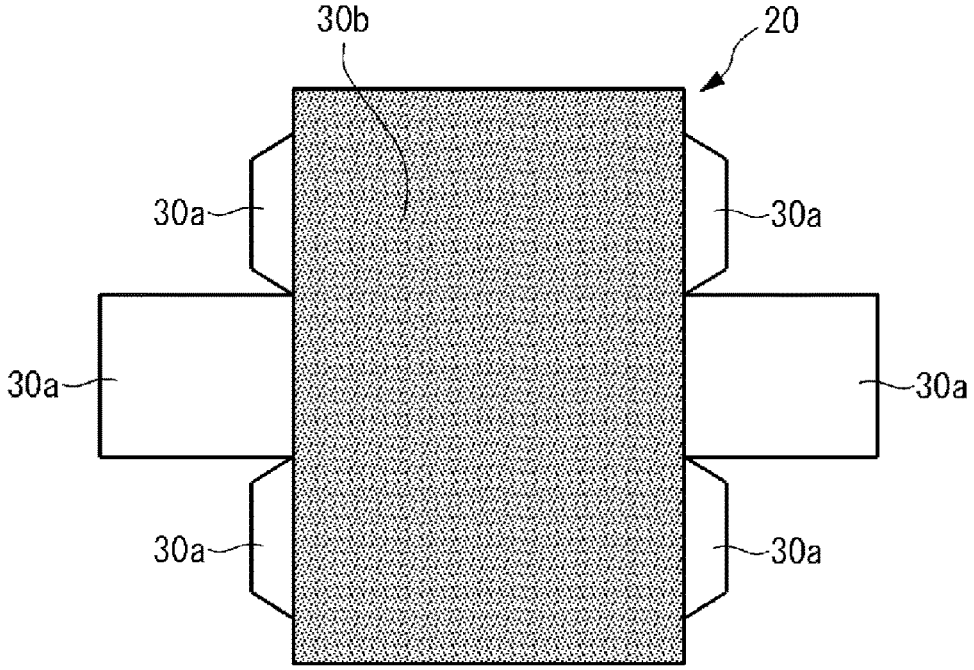
FIG. 6 is a figure for explaining the manufacturing process of a packaging box sheet.

Next, as shown in FIG. 6, the release paper 30*a* is peeled off along the notch corresponding to the contour line 26 to expose the pressure sensitive adhesive layer 30*b* in this region. In FIG. 6, the region where the pressure sensitive adhesive layer 30*b* is exposed is shown with a pattern for ease of understanding.

Figure 7:
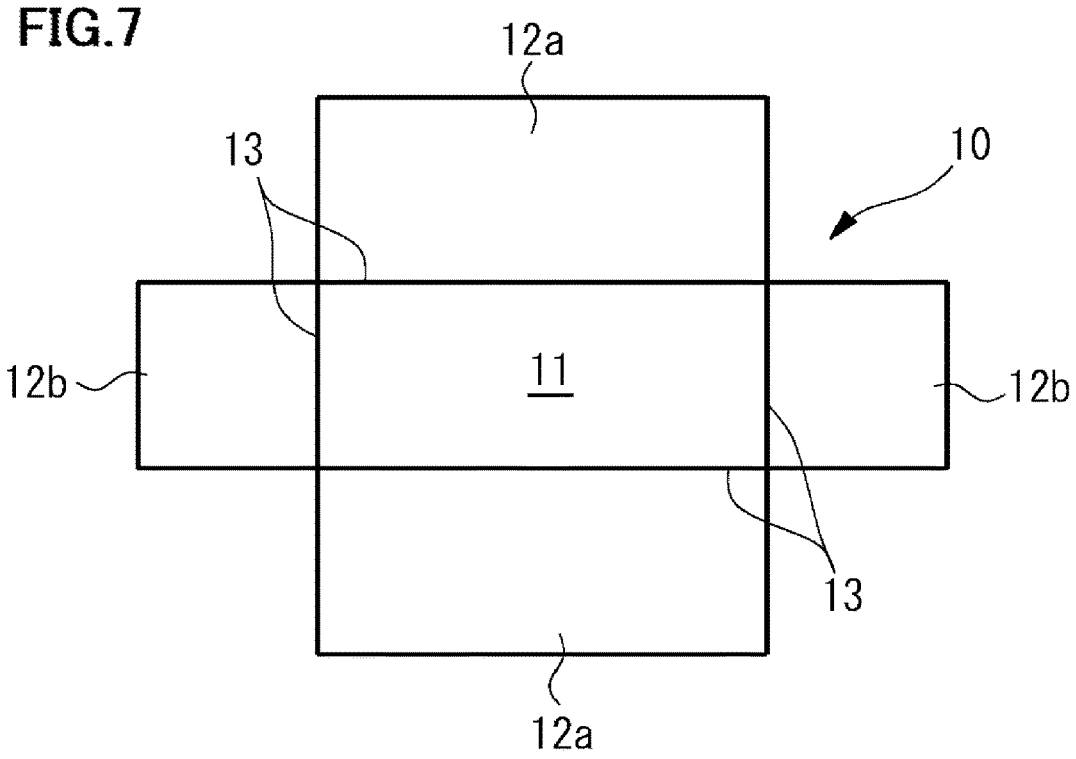
FIG. 7 is a figure for explaining the manufacturing process of a packaging box sheet.

On the other hand, the mounting board 10 is formed by punching out a paperboard sheet (refer to FIG. 7). In addition, notch grooves 13 are also formed.

Figure 8:
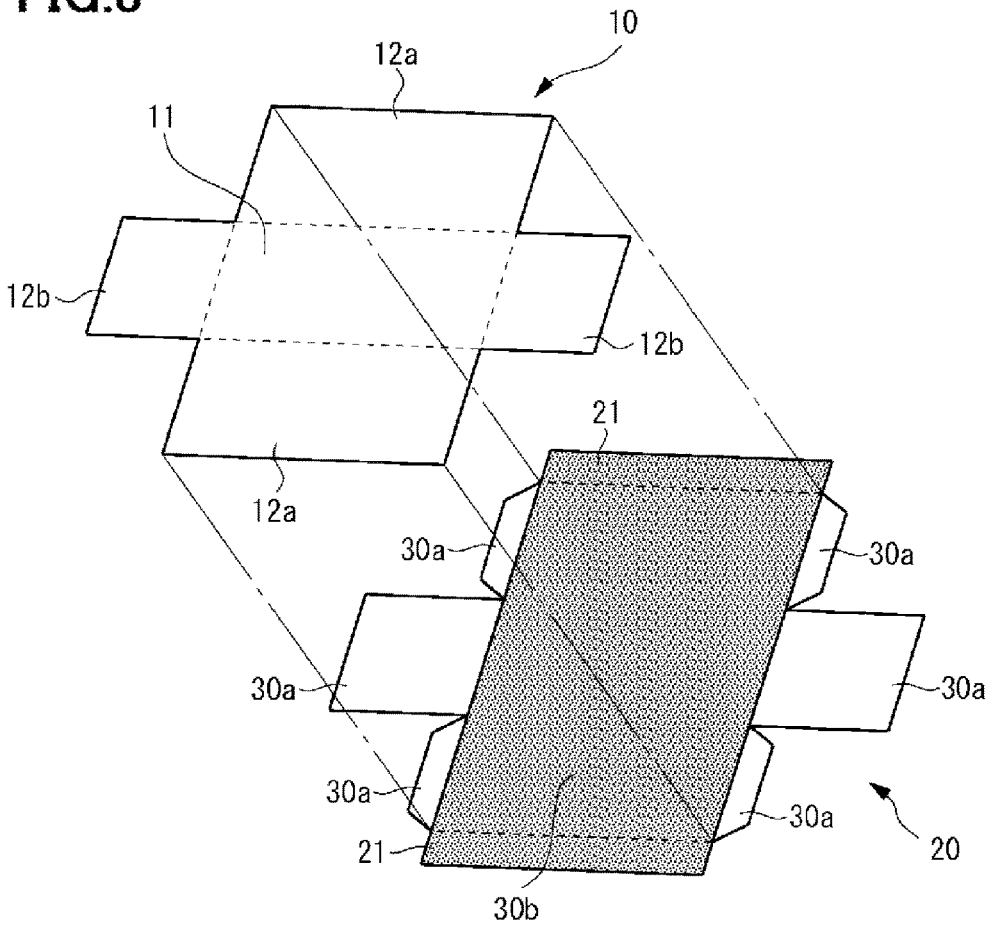
FIG. 8 is a figure for explaining the manufacturing process of a packaging box sheet.

Next, as shown in FIG. 8, the mounting board 10 is placed on the exposed pressure sensitive adhesive layer 30*b* region obtained in the above step so that the surface on which the notch grooves 13 are not formed faces the pressure sensitive adhesive layer 30*b* and affixed thereto. At this time, the exposed pressure sensitive adhesive layer 30*b* region obtained by peeling off the release sheet 30*a* and the outer surfaces of the bottom board 11 and the side boards 12*a* of the mounting board 10 are aligned to overlap accurately, and the two are affixed together. Since this process can be performed by using dedicated equipment or the like in the manufacturing factory, the alignment accuracy can be improved. Thereafter, the folding-in strips 21 of the side boards 12*a* are affixed to the inner surface of the side boards 12*a* thereby the packaging box sheet 1 shown in FIG. 1 is completed.

It should be noted that this invention is not limited to the subject matter of the foregoing embodiment, and can be implemented by being variously modified within the scope of the present invention. For example, the folding-in strips 21 may be omitted. Further, the shapes (outer periphery shapes) of the bottom board 11 and the side boards 12*a*, 12*b* when viewed in a plane view are merely an example, and for example, the outer periphery shape of the bottom board 11 when viewed in the plane view may be a polygon other than a quadrangle.

Further, in the above-described embodiment, the decorative paper 20 is affixed in advance to the bottom board 11 and the two side boards 12*a*, but the present invention is not limited thereto, and it suffices when the decorative paper 20 is aligned and affixed in advance to at lease one of the boards constituting the mounting board 10 (at least one of the bottom board 11 or the side boards 12*a*, 12*b*). In this case, it is preferable to affix the decorative paper to the board having the largest area among the bottom board 11 and the side boards. The alignment accuracy of the mounting board 10 and the decorative paper 20 is improved, and during transportation, etc., since the unaffixed portion of the mounting board 10 and the decorative paper 20 is relatively small, the packaging box sheet 1 can be handled easily. Further, with regard to the boards unaffixed to the decorative paper 20, it is preferable to provide them with the pressure sensitive adhesive layer 30*b* and the release paper 30*a*.

When the decorative paper 20 is affixed to either one of the boards in advance, for example, it is preferable to affix it to the bottom board 11. By affixing the decorative paper 20 to the bottom board 11 in advance, with regard to the four sides of the bottom board 11, each portion of the decorative paper 20 corresponding to the side boards 12*a*, 12*b* is aligned in advance, thereby when each portion of the decorative paper 20 is affixed to the side boards 12*a*, 12*b* during the assembly process, misalignment of the decorative paper 20 is unlikely to occur. Here, the decorative paper 20 may be affixed in advance to one of the side board 12*a* or the side board 12*b*, or may be affixed in advance to two boards which are the bottom board 11 and one of the side board 12*a*.

Further, in the above-described embodiment, four side boards 12*a*, 12*b* are provided to the rectangular bottom board 11, but the present invention is not limited thereto, and only three side boards 12*a*, 12*a* and 12*b* or three side boards 12*a*, 12*b*, and 12*b* may be provided to form openings in two directions when assembled. Alternatively, only two side boards 12*a*, 12*b* may be provided to form openings in three directions when assembled.

Figure 9:
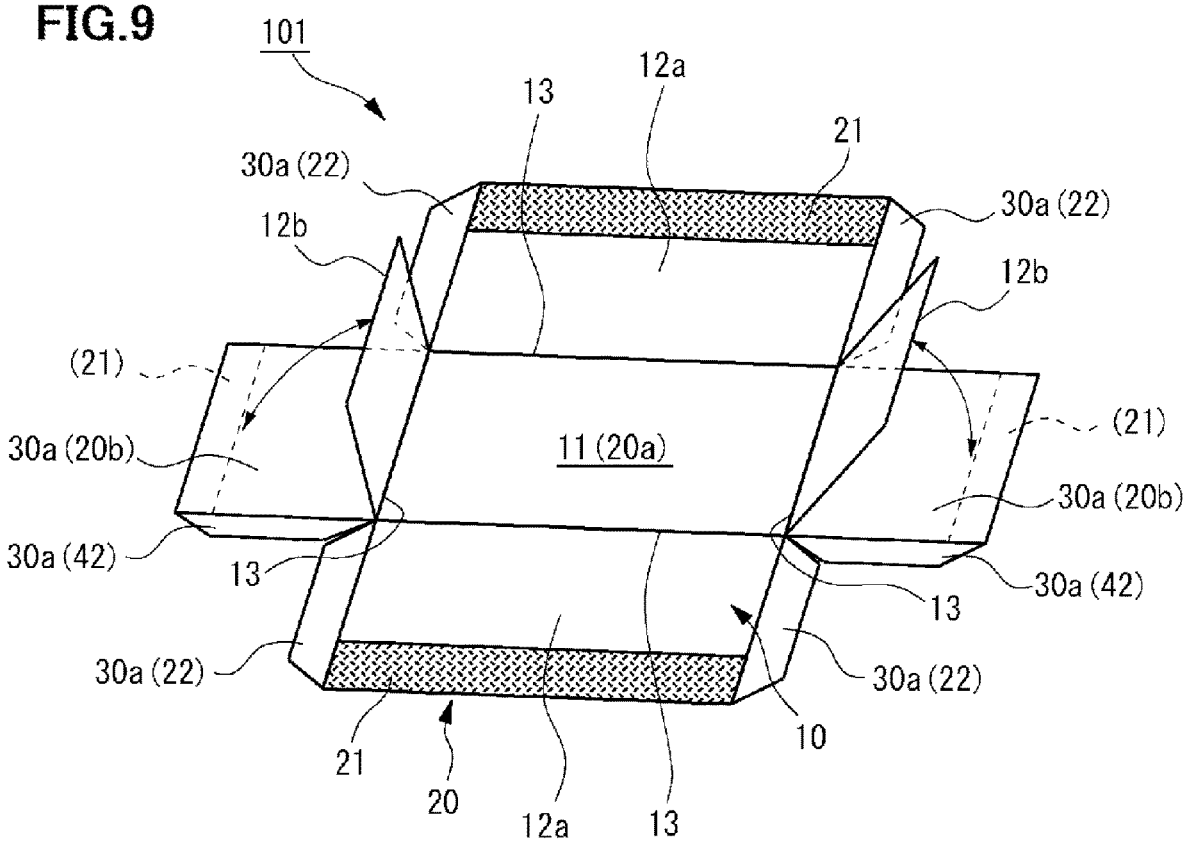
FIG. 9 is a plane view of a modified example of a packaging box sheet.
Figure 10:
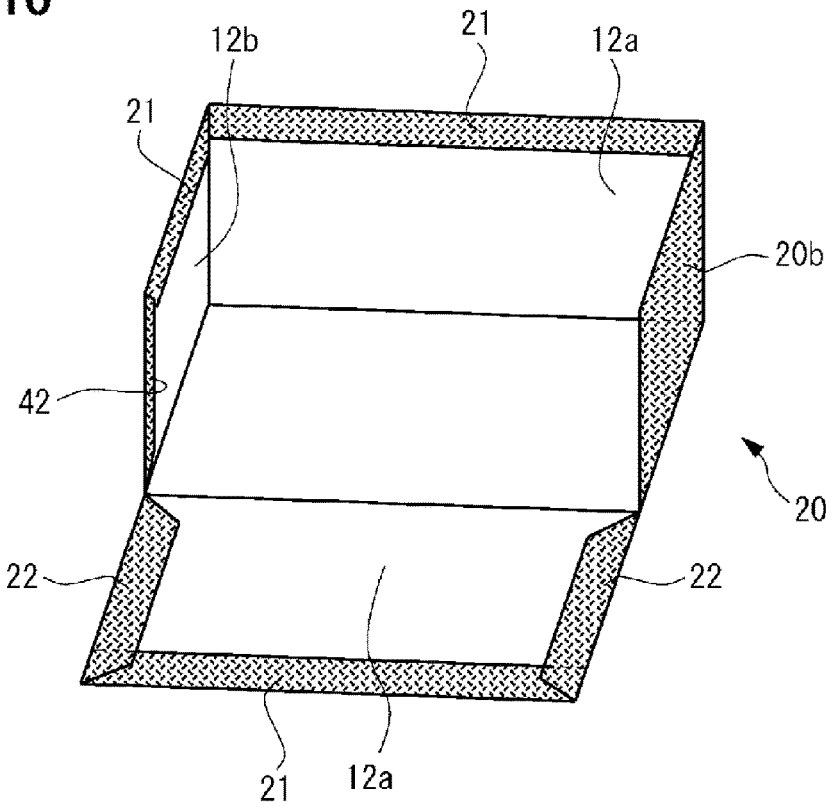
FIG. 10 is a perspective view of the packaging box after a modified example of a packaging box sheet is assembled.

Further, as shown in FIG. 9, the decorative paper 20 may be provided with a plurality of folding-in strips 42 protruding from one side of the side boards 12*b* toward the side boards 12*a* side. In this case, a pressure sensitive adhesive layer 30*b* and a release paper 30*a* covering pressure sensitive adhesive layer 30*b* are provided to each folding-in strip 42. By providing such folding-in strips 42, as shown in FIG. 10, an affixed box with an openable side board 12*a* can be obtained. In this case, by folding each folding-in strip 42 inward to each side board 12*b* and by folding each flap part 22 inward to each side board 12*a* to affix them together, the aesthetic appearance of the inner side of the openable side board 12*a* can be improved.

Figure 11:
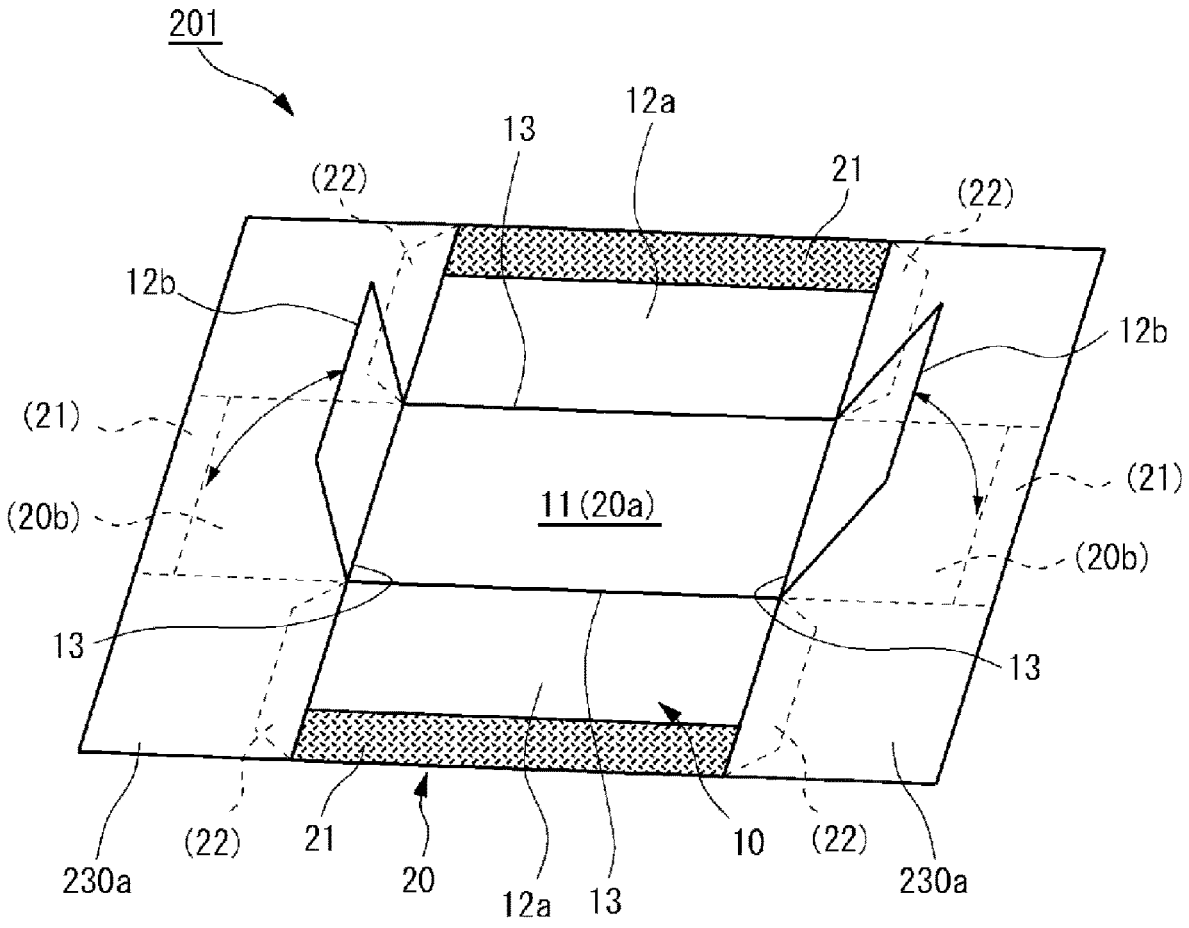
FIG. 11 is a plane view of a modified example of a packaging box sheet.

Further, in the above embodiment, the second paper portion 20*b* of the decorative paper 20 corresponding to the side board 12*b*, the release paper 30*a* corresponding to the folding-in strip 21, and the release paper 30*a* of the flap part 22 are provided separately, but these may be connected. In this case, for example, as shown in FIG. 11, it is also preferable to provide a single sheet of rectangular shaped release paper 230*a* covering one second paper portion 20*b* and the two flap parts 22 corresponding thereto provided on both sides thereof. In this case, as illustrated in the example shown in the figure, it is preferable that one side of the rectangular release paper 230*a* is aligned with the end portions of the side boards 12*a* and the bottom board 11, and the opposing side of the rectangular release paper 230*a* is aligned with the end portion of the folding-in strip 21. Further, it is preferable that the release paper 230*a* is provided so that the entire outer periphery shape of the release paper 230*a* combined with the mounting board 10 is substantially rectangular when viewed in a plane view. As a result, when a large number of stacked packaging box sheets 201 are placed into a transporting box, misalignment among the packaging box sheets 201 is unlikely to occur thereby preventing damages to the packaging box sheets 201. Further, since the second paper portions 20*b* and the release paper 230 covering the flap parts 22 are connected and integrated, when assembling the affixed box, the release paper 230 can be peeled off in a single operation.

FIG. 12 is a figure for explaining an example of a method for manufacturing the packaging box sheet of the above-described modified example shown in FIG. 11. As shown in FIG. 12(A), the decorative paper 20 is formed by punching out a base material sheet of the decorative paper. Next, as shown in FIG. 12(B), on the entire surface of the formed decorative paper 20, a pressure sensitive adhesive layer 30*b* is applied. Next, as shown in FIG. 12(C), a rectangular release paper sheet 230*a* which is prepared in advance is affixed to a predetermined position (the position covering the folding-in strips 21 and the second paper portions 20*b*). Next, as shown in FIG. 12(D), to the rectangular portion of the decorative paper 20 which is not covered with the release papers 230*a*, the mounting board 10 is aligned and affixed. Thereafter, as shown in FIG. 12(E), the folding-in strips 21 are folded inwardly and affixed to the inner surface of the mounting board 10. According to the above, the packaging box sheet 201 of the modified example is completed.

This manufacturing method, compared to the manufacturing method of the above-described embodiment, requires only a punching process of forming the decorative paper 20, and does not require a process where a release paper is provided and peeled off to the area corresponding to the bottom board 11 and the side boards 12*a* of the mounting board 10, thereby realizing labor savings in the manufacturing process and reducing the consumption of release papers as well.

Figure 12A:
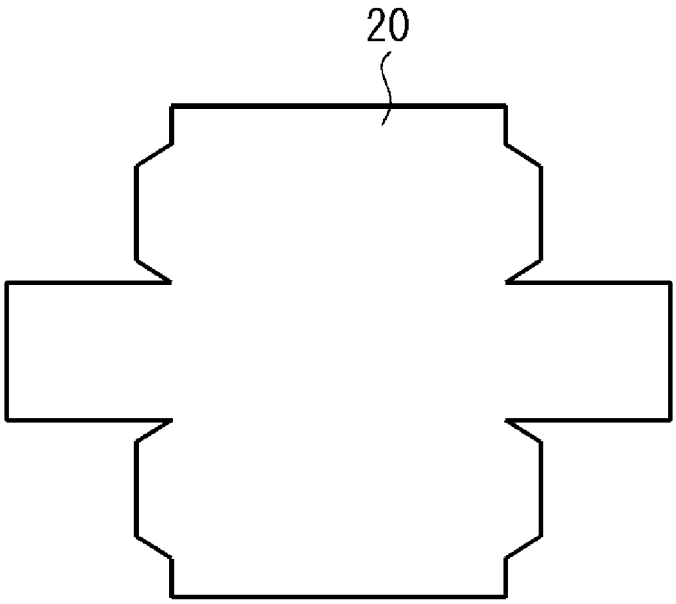
FIGS. 12A-F are figures for explaining the manufacturing process of a modified example of a packaging box sheet.
Figure 12B:
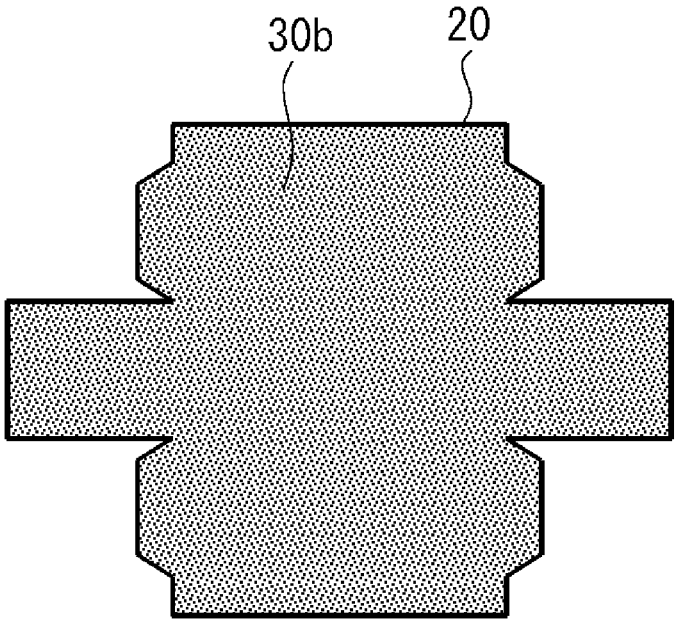
Figure 12C:
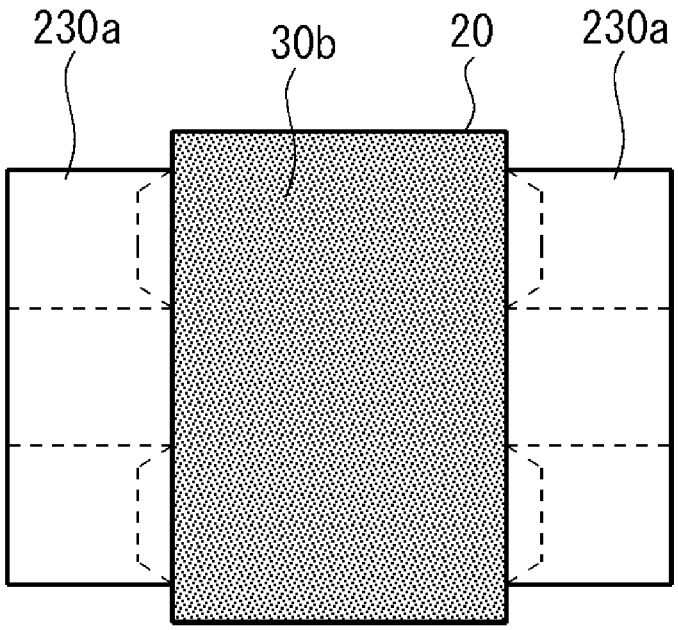
Figure 12D:
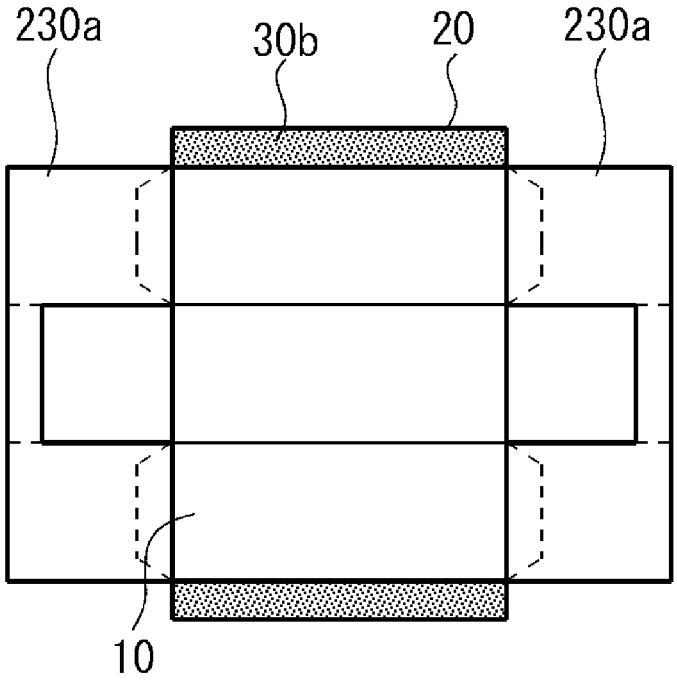
Figure 12E:
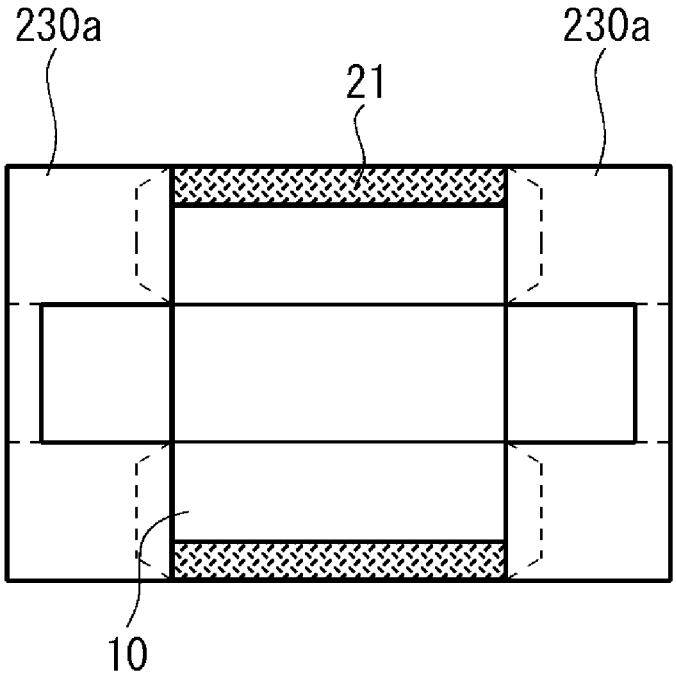
Figure 12F:
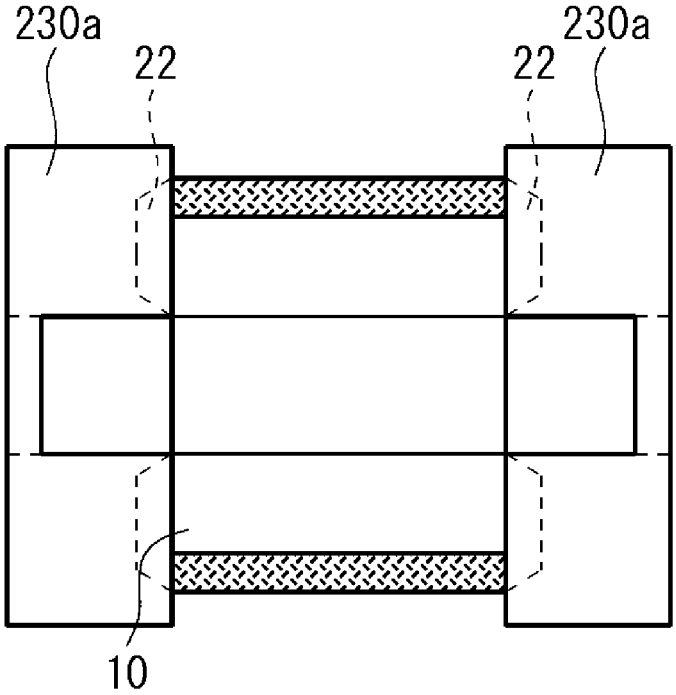

Note that, as shown in FIG. 12(F), the release paper 230*a* may be made relatively large and be provided so as to protrude beyond the flap parts 22 in the vertical direction in the figure. In this case, when the packaging box sheets are placed in the transporting box, gaps are generated between the inner surface of the transporting box and the end part of the side where the mounting board 10 is covered by the folding-in strips 21. Thereby, even when the plurality packaging box sheets 201 is placed in the box without being wrapped with a vinyl bag or the like, the decorative paper 20 at the end portion of the mounting board 10 can be prevented from damages (friction, etc.).

The invention claimed is:

1. A packaging box sheet assembled to obtain an affixed box comprising:

a sheet-like mounting board; and a decorative paper disposed on the outer surface of the mounting board;

wherein the mounting board includes:

a bottom board whose outer periphery is a quadrangle shape when viewed in a plane view;

two first side boards facing each other across the bottom board in which each of the first side boards is connected to one of the four sides of the outer edge of the bottom board, and two second side boards facing each other across the bottom board in which each of the second side boards is connected to one of the four sides of the outer edge of the bottom board, wherein the decorative paper includes:

a first paper portion affixed to the bottom board and each of the first side boards;

two second paper portions which correspond to each of the second side boards, where each second paper portion is connected to the first paper portion, and where the second paper portion is not affixed to and is separated from each of the second side boards; and four third paper portions each connected to the first paper portion and configured to project from each side of the two first side boards toward one of the two second side boards; and wherein the second paper portion and the third paper portion respectively have an adhesive layer and a release paper covering the adhesive layer, wherein each of the third paper portions is configured to connect the second side board and the first side board which is adjacent to the second side board, by peeling off the release paper, and then bringing the adhesive layer into contact with one of the second side boards and adhering the adhesive layer to the second side board, wherein each of the second paper portion of the decorative paper is configured to bond to the second side board, by peeling off the release paper, and covers the third paper portion after the third paper is bonded to the second side board, wherein each of the release papers of the second paper portion and the two release papers of the third paper portions provided on both sides thereof are integrated and connected to one another.

2. The packaging box sheet according to claim 1, wherein the integrated release paper is configured such that the entire outer edge including the mounting board has a rectangular shape in a plane view.

3. The packaging box sheet according to claim 1, wherein each third paper portion has a trapezoidal-shape outer edge whose base has the same length as the side edge portion of the first side board.

4. The packaging box sheet according to claim 1, wherein the third paper portion of the decorative paper connects the plurality of first side boards and the plurality of second side boards by peeling off the release paper and bringing the adhesive layer into contact with the plurality of second side boards and affixing it to the plurality of second side boards.

5. The packaging box sheet according to claim 4, wherein the second paper portion of the decorative paper is affixed to the plurality of second side boards covering the third paper portion after the third paper portion is affixed to the plurality of second side boards.

6. A packaging box sheet assembled to obtain an affixed box comprising:

a sheet-like mounting board; and a decorative paper disposed on the outer surface of the mounting board;

wherein the mounting board includes:

a bottom board whose outer periphery is a quadrangle shape when viewed in a plane view;

two first side boards facing each other across the bottom board in which each of the first side boards is connected to one of the four sides of the outer edge of the bottom board, and two second side boards facing each other across the bottom board in which each of the second side boards is connected to one of the four sides of the outer edge of the bottom board, wherein the decorative paper includes:

a first paper portion affixed to the bottom board and each of the first side boards;

two second paper portions which correspond to each of the second side boards, where each second paper portion is connected to the first paper portion, and where the second paper portion is not affixed to and is separated from each of the second side boards; and four third paper portions each connected to the first paper portion and configured to project from each side of the two first side boards toward one of the two second side boards; and wherein the second paper portion and the third paper portion respectively have an adhesive layer and a release paper covering the adhesive layer, wherein each of the third paper portions is configured to connect the second side board and the first side board which is adjacent to the second side board, by peeling off the release paper, and then bringing the adhesive layer into contact with one of the second side boards and adhering the adhesive layer to the second side board, wherein each of the second paper portion of the decorative paper is configured to bond to the second side board, by peeling off the release paper, and covers the third paper portion after the third paper is bonded to the second side board, wherein the mounting board has a V-shaped cross sectional notch groove that does not penetrate the mounting board at the connecting point between the bottom board and each of the first side boards and the second side boards.

7. The packaging box sheet according to claim 1, wherein the surface areas of the bottom board and/or the plurality of first side boards are larger than the surface area of the plurality of second side boards.

8. The packaging box sheet according to claim 7, wherein the third paper portion of the decorative paper connects the plurality of first side boards and the plurality of second side boards by peeling off the release paper and bringing the adhesive layer into contact with the plurality of second side boards and affixing it to the plurality of second side boards.

9. The packaging box sheet according to claim 8, wherein the second paper portion of the decorative paper is affixed to the plurality of second side boards covering the third paper portion after the third paper portion is affixed to the plurality of second side boards.

10. The packaging box sheet according to claim 1, wherein the third paper portion of the decorative paper connects the plurality of first side boards and the plurality of second side boards by peeling off the release paper and bringing the adhesive layer into contact with the plurality of second side boards and affixing it to the plurality of second side boards.

11. The packaging box sheet according to claim 10, wherein the second paper portion of the decorative paper is affixed to the plurality of second side boards covering the third paper portion after the third paper portion is affixed to the plurality of second side boards.

* * * * *